United States Patent [19]

Mori

[11] Patent Number: 4,952,974

[45] Date of Patent: Aug. 28, 1990

[54] DETECTING MEMBER FOR DETECTING THE PRESENCE OF AN EXCHANGEABLE UNIT IN AN IMAGE RECORDING APPARATUS

[75] Inventor: Seiichi Mori, Tokyo, Japan

[73] Assignee: Asahi Kogaku Kogyo Kabushiki Kaisha, Tokyo, Japan

[21] Appl. No.: 422,592

[22] Filed: Oct. 17, 1989

[30] Foreign Application Priority Data

Oct. 17, 1988 [JP] Japan ..... 63-135257[U]

[51] Int. Cl.[5] ..... G03G 15/00

[52] U.S. Cl. ..... 355/200; 355/260

[58] Field of Search ..... 355/200, 210, 260, 298, 355/245, 326

[56] References Cited

U.S. PATENT DOCUMENTS 4,720,730 1/1988 Ito ..... 355/246 X
4,841,329 6/1989 Kasamura et al. ..... 355/326 X
4,876,572 10/1989 Nagatsuna ..... 355/200 X

FOREIGN PATENT DOCUMENTS 0296367 12/1986 Japan ..... 355/210
0214766 9/1988 Japan ..... 355/210

*Primary Examiner*—A. T. Grimley
*Assistant Examiner*—William J. Royer
*Attorney, Agent, or Firm*—Sandler, Greenblum & Bernstein

[57] ABSTRACT

An image recording apparatus employs an electrophotographic process wherein a recording medium is fed along a predetermined feed path, a photoconductive drum on which a toner image is formed is arranged below the feed path and a transfer unit is arranged above the feed path oppositley to the photoconductive drum so as to transfer the toner image formed on the photoconductive drum onto the undersurface of the recording medium. An upper component arranged above the photoconductive drum is arranged openably with respect to a lower component in which the photoconductive drum and a unit which is exchangeable are disposed. A detecting member, which detects the presence of the exchangeable unit when the upper component is closed with respect to the lower component, is provided on the upper component.

8 Claims, 6 Drawing Sheets

DETECTING MEMBER FOR DETECTING THE PRESENCE OF AN EXCHANGEABLE UNIT IN AN IMAGE RECORDING APPARATUS

BACKGROUND OF THE INVENTION

The present invention relates to an image recording apparatus employing an electrophotographic system.

Conventionally, there is known an image recording device utilizing an electrophotographic system in which a surface of a photoconductive drum is exposed to light to form a latent image on the drum surface. Toner is then applied to the latent image to develop the image, and the developed image is transferred onto a recording sheet and is fixed by a fixing unit. Such image recording device is chiefly employed in a copying machine. In recent years, however, the image recording device is being utilized as a printer for printing output from a computer, and is formed as is a laser beam printer.

The laser beam printer comprises, for example as illustrated in FIG. 1, a photoconductive drum 1. Arranged about the photoconductive drum 1 in order in a rotational direction thereof are a charging station A, an exposure station B, a developing station C, a transferring station D, a toner-cleaning station E, and a discharge station F.

The arrangement is such that at the exposure station B, the laser beam scans the surface of the drum 1 which has been uniformly charged at the charging station A, to thereby form a latent image on the charged drum surface. Toner is then applied at the developing station C to the latent image to develop the same. Subsequently, the developed toner image is transferred at the transferring station D onto the recording sheet P fed at a velocity identical with the circumferential speed of the photoconductive drum 1. The recording sheet P carrying the toner image transferred thereon at the transfer station D is guided and/or fed by guide rollers to a fixing station G. The recording paper P is then heated and/or pressed at the fixing station G so that the toner image will be fixed on the surface of the recording sheet P.

The constitution of the laser beam printer is substantially similar to that of an electronic copying machine except for the exposure station. Actually, principal parts of the electronic copying machine are often commonly used for conventional laser beam printers.

The electronic copying machine is designed so that an image-carrying surface can instantly be viewed by transferring the toner image onto the upper surface of the recording sheet and discharging the recording sheet with the image-carrying side up (so-called "faceup discharging"). This naturally results in the fact that the faceup discharging system is employed in the laser beam printer having the principal parts in common with the electronic copying machine.

However, printers are normally used to print out the sheets continuously and, if the sheets are discharged with the image-carrying surfaces up, they will be stacked in inverted order of pages. As a result, it has been desirable for the laser beam printers capable of discharging the sheets with their image-carrying surfaces down (so-called "facedown discharging") so the the sheets are stacked in the proper order of pages.

Although such a printer is not limited in constitution to what has been described above, each of the operating units disposed around a photoconductive drum has to be detachable not only for maintenance but also for replacement after the passage of its life is taken into consideration. For this reason, these operating units have to be provided with respective locking mechanisms to make them detachable. Moreover, the printer also has to be arranged so that it is not operated while any one of the detachable operating units is not set in position so that it is not operated without it. As a result, the printer may become complicated in construction and costly because a number of locking mechanisms are required therefor.

SUMMARY OF THE INVENTION

It is therefore an object of the invention to provide an image recording apparatus employing an electrophotographic system which is simple in construction and less costly by the use of means for locking operating units in position and commonly detecting that they are locked.

In order to accomplish the foregoing object, according to the present invention, an image recording apparatus employs an electrophotographic system wherein a recording medium is fed along a predetermined feed path. A photoconductive drum, on which a toner image is formed, is arranged below the feed path and a transfer unit is arranged above the feed path opposite the photoconductive drum so as to transfer the toner image formed on the photoconductive drum onto the under surface of the recording medium. An upper component is arranged above the photoconductive drum and is openable with respect to a lower component in which the photoconductive drum and a unit which is exchangeable are disposed. A detecting member which detects the presence of the exchangeable unit when the upper component is closed with respect to the lower component, is provided on the upper component.

DESCRIPTION OF THE ACCOMPANY DRAWINGS

DESCRIPTION OF THE EMBODIMENT

Figure 1:
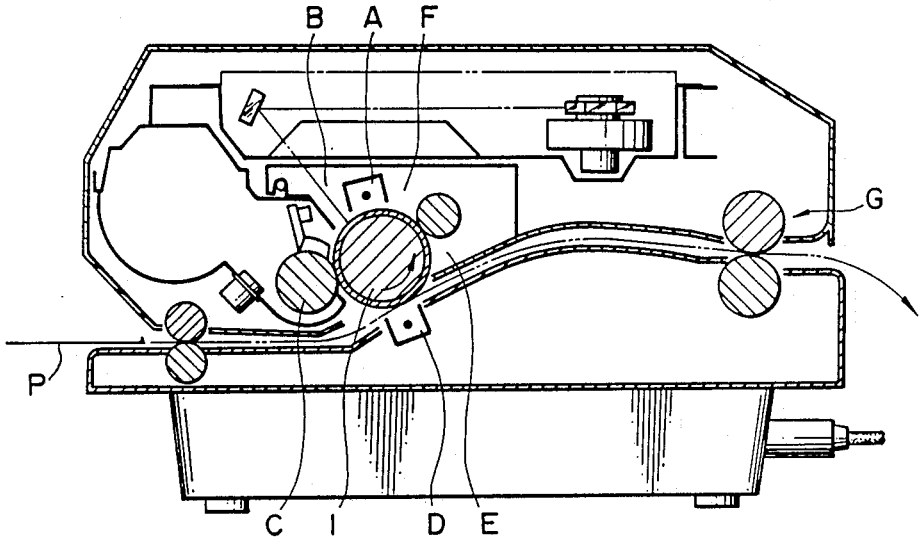
FIG. 1 PRIOR ART
FIG. 1 is a schematic side view illustrating the system configuration of a conventional laser beam printer.
Figure 2:
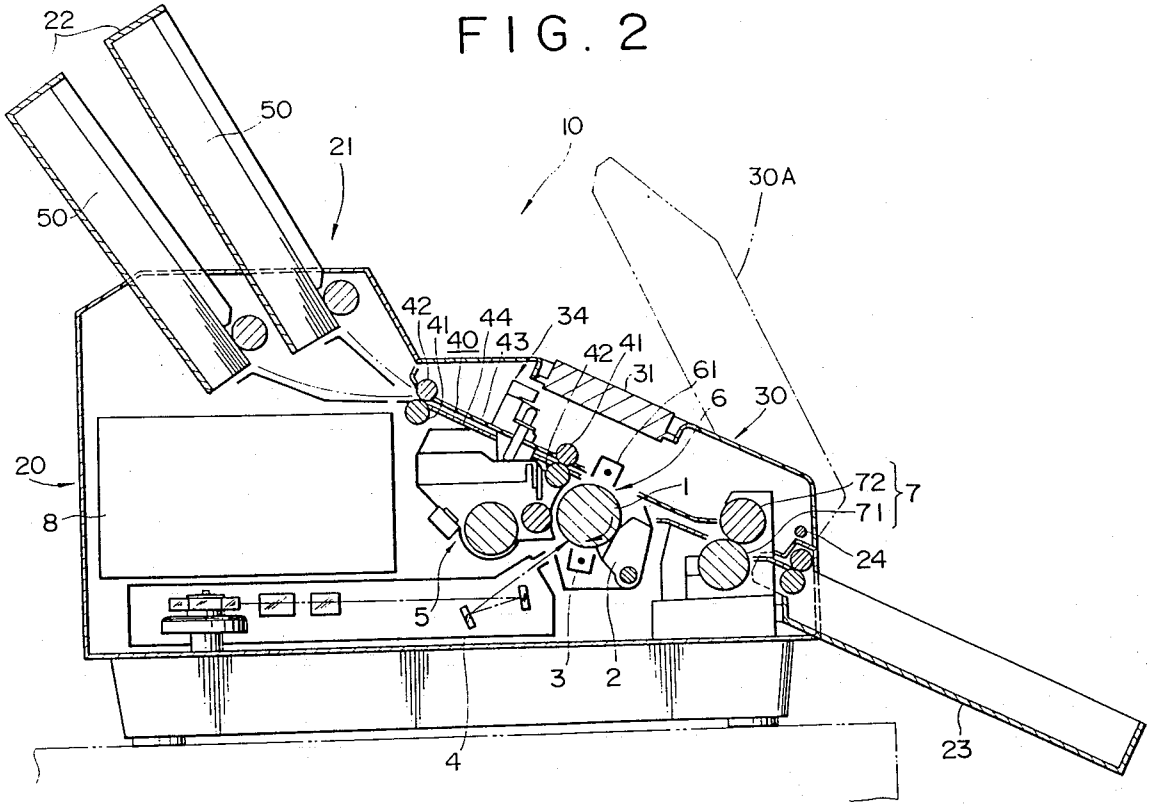
FIG. 2 is a schematic side view illustrating a laser beam printer as an image recording apparatus embodying the present invention.

FIG. 2 is a schematic side view illustrating a laser beam printer employing an electrophotographic system embodying the present invention, this printer being a so-called page printer in which cut-sheets cut into predetermined sizes are used.

The laser beam printer 10 shown in FIG. 2 looks like a rectangular parallelepiped with its top diagonally cut at a predetermined angle and consists of a body 20 and a clamshell 30.

The uppermost section of the body 20 forms a cassette holding portion 21 to receive a pair of paper cassettes 22, 22 in which papers which differ in size are respectively stored. While printing is being executed, the recording papers are sequentially introduced one by one into a paper feed path 40.

A discharge paper tray 23 is provided at the side of the body 20 opposite in the diagonal direction to the cassette holding portion 21.

The clamshell 30 forms an inclined surface portion of the printer 10 and its lower end portion is rockably coupled to the body 20 by means of a pivot shaft 24. On the other hand, the upper end portion of the clamshell 30 is allowed to rock away from the body 20 with the shaft 24 as a fulcrum so that the clamshell 30 is able to open as shown by an imaginary line 30A in FIG. 2. A control panel 31 for operating the printer 10 is disposed on the inclined surface of the clamshell 30.

Figure 4:
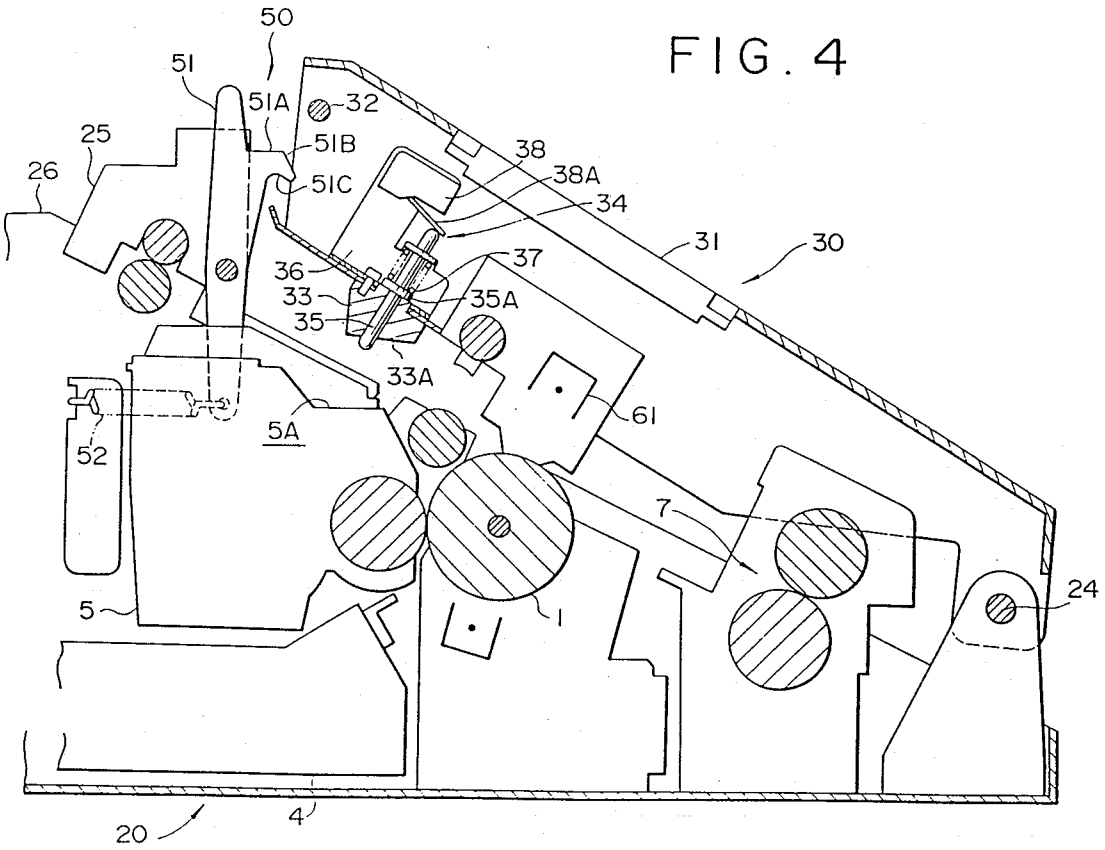
FIG. 4 is an enlarged view of the principal part of the opened upper component member.
Figure 5:
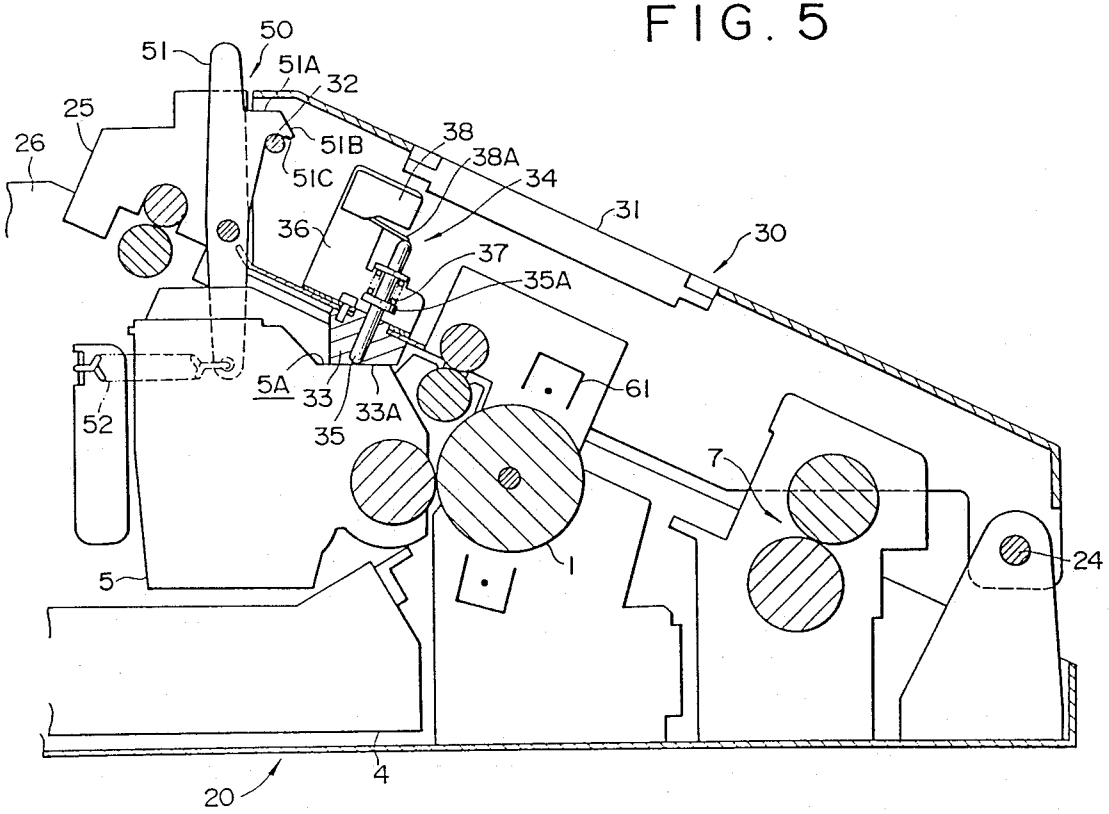
FIGS. 5 and 6 are enlarged views of the principal part of the closed upper component member.
Figure 6:
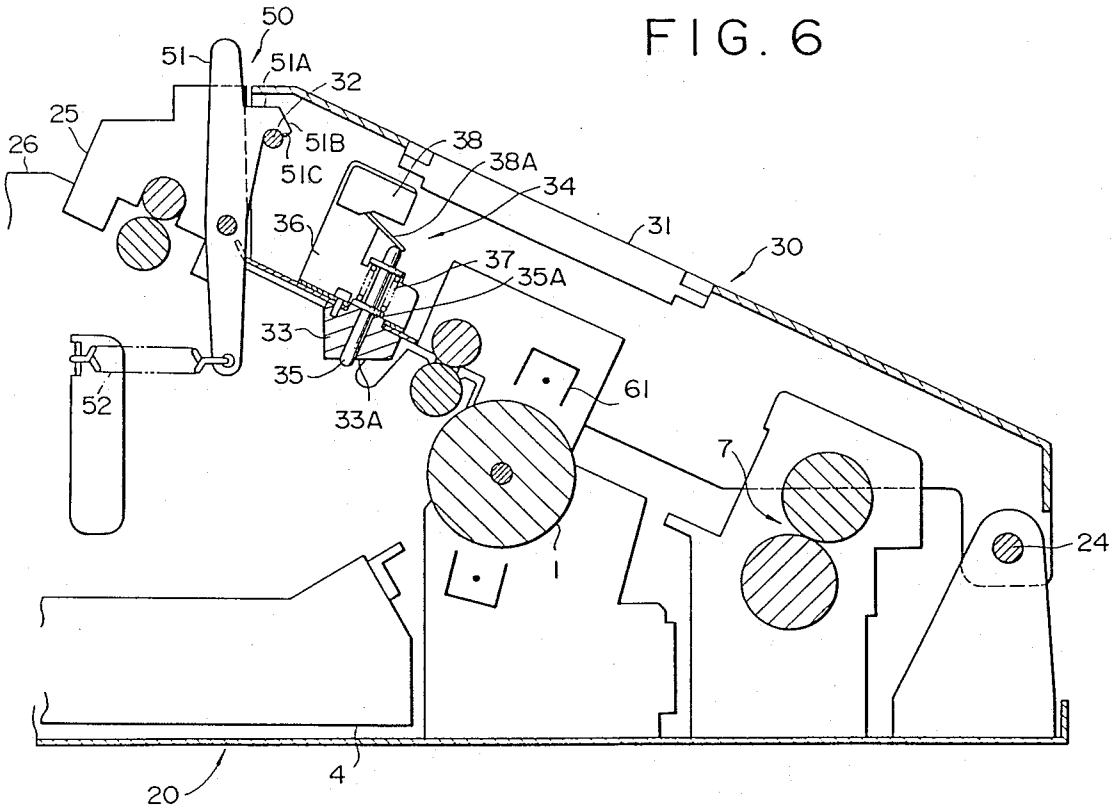

As shown in FIGS. 4 to 6, a clamshell locking mechanism 50 is provided in a position corresponding to the upper end of the clamshell 30 of the body 20.

The locking mechanism 50 is equipped with levers 51 formed in lengths above the surfaces of respective brackets 25 fixed to the body 20 by predetermined amount with the substantially central portion of each lever pivoted substantially perpendicularly in such a manner that it is capable of rocking.

The lever 51 has the lower end mated with one end of a coil spring 52 the other end of which is secured to the frame 20 via an appropriate member. The upper end of the lever 51 is biased by the coil spring 52 in a direction in which that end rocks toward the clamshell 30.

A mating pawl 51A projects from the vicinity of the upper end of each lever 51 and faces the clamshell 30.

The mating pawl 51A has its surface 51B tilted by a predetermined angle in a direction in which it lowers toward the clamshell 30 and its under surface is provided with a semicircular cut capable of mating with a mating pin 32, as described later, on the side of clamshell 30. Identical levers 51 pawls 51A, and mating pins 32 are provided at each side of the clamshell.

The mating pin 32 is fixed to a position corresponding in the mating pawl 51A of the lever of the body 20. When the clamshell 30 is closed, the mating pins 32 abut against the inclined surfaces 51B of the mating pawls 51A of the mating pins 32 and cause the upper ends of the levers 51 to rock in a direction in which the upper ends move away from the clamshell 30 against the tensile force of the coil springs 52, whereby the pins 32 are located under the mating pawls 51A to mate with cuts 51C. The clamshell 30 becomes locked in the closed state. In order to release the locked condition, the upper ends of the levers 51 which projects from the surface of the clamshell 30 are caused to rock in the release direction (i.e. in the direction in which they are detached from the clamshell 30).

An upper cover plate 44 of the body 20 and a lower cover plate 43 of the clamshell 30 define therebetween the paper feed path 40 (FIG. 2) when the clamshell 30 is closed with respect to the body 20. The clamshell 30 has substantially uniform thickness and the paper feed path 40 is directed downward at substantially the same inclination angle as that of the inclined surface of the clamshell 30.

A pair of opposed feed rollers 41, 42 are respectively provided on the cover plates 43, 44, one of which is driven to rotate by a drive means, not shown.

A photoconductive drum 1 is disposed under the substantially central area of the paper feed path 40 in the body 20.

Around the photoconductive drum 1 in the body 20, the following units are disposed along the following direction of its rotation in the order: a cleaning unit 2 for removing toner remaining on the surface of the drum 1, a charging unit 3 for uniformly charging the surface of the drum 1, an optical scanning system 4 for scanning the charged surface of the drum 1 with laser beams carrying image data to form a latent image thereon, and a developing unit 5 for putting toner onto the portion of the surface of the drum 1 exposed to the laser beams to develop a toner image. A reference numeral 8 represents a control unit for controlling the operation of the printer 10 including a power source.

A corona charger 61 for charging the recording paper 50 so that the toner image on the drum 1 is transferred thereonto is disposed in the clamshell 30 opposite to the drum 1 with the paper feed path 40 therebetween. The corona charger 61 and the portion of the drum 1 opposed thereto constitute a transfer unit 6.

A fixing unit 7 is arranged downstream of the transfer unit 7 along the paper feed path 40.

The fixing unit 7 comprises a heat roll 71 and a backup roll 72 opposedly disposed and defining the paper feed path 40 therebetween. The recording paper 50 carrying the unfixed toner image is nipped between the rolls 71, 72 and the toner is fixed onto the recording paper 50 by heat and pressure applied by the heat roll 71. A drive motor, not shown, is employed to rotate the heat roll 71 to feed the recording paper 50 in the fixing unit 7.

Figure 3:
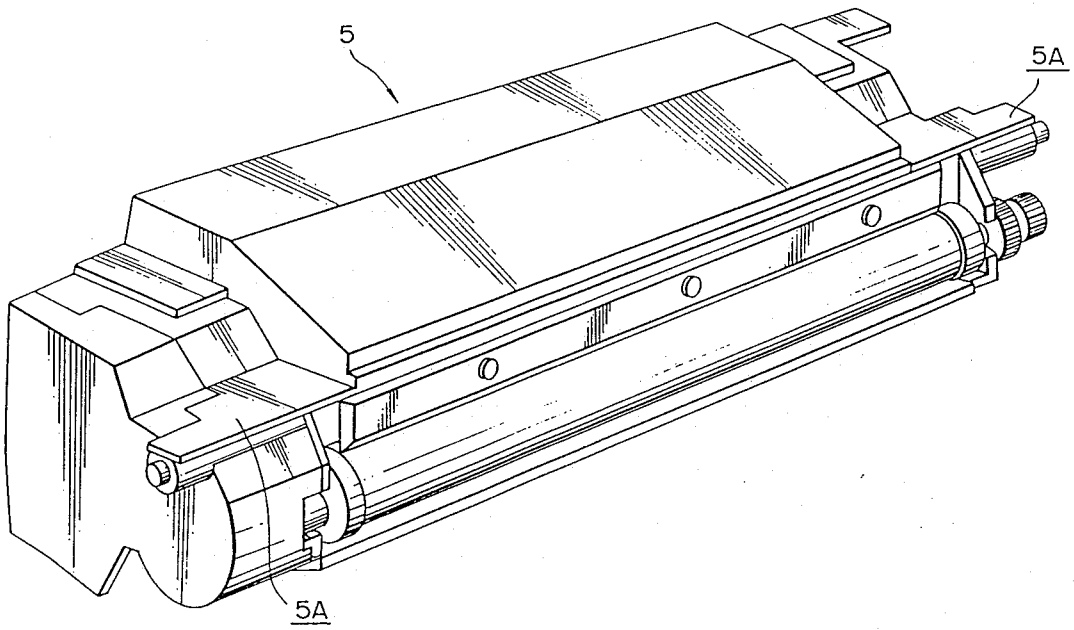
FIG. 3 is a perspective view of the developing unit.

The developing unit 5 is, as shown in FIG. 3, formed as a unit and can be detached or replaced on a unit basis at the time of maintenance or replacement upon the expiration of its useful life. Flat clamp portions 5A are formed on the surfaces of both ends of the developing unit 5 to secure the flat clamp portions to the body 20 by pressing them from the upward.

A positioning part (not shown) for the developing unit 5 is formed in the body 20 and the developing unit 5 can be positioned only by seating it in (seating) position.

Press locking members 33 are secured in positions corresponding to the respective clamp portions 5A of the developing unit 5 and press down the clamp portions 5A of the developing unit 5 with the undersurfaces 33A of the press locking members 33 seated at the respective positions of the body 20 when the clamshell 30 is closed and locked with respect to the body 20. The developing unit 5 is thus secured to the set position of the body 20.

The press locking member 33 is provided with a detection mechanism 34 as a detection means.

The detection mechanism 34 is arranged by sliding a sensor pin 35 through the press locking member 33, slidably passing its upper end which projects from the press locking member through a bracket 36 which is secured to the clamshell 30 and holding a spring 37 between a large diameter rim 35A formed in the substantially central portion of the sensor pin 35 and the bracket 36. More specifically, the sensor pin 35 is always biased by the spring 37 so that its front end projects downwardly from the undersurface 33A of the press locking member 33 by a predetermined amount. Moreover, the upper end of the sensor pin 35 abuts against a lever 38A of a microswitch 38 which is secured to the bracket 36 and, when the sensor pin 35 slides against the biasing force of the spring 37, to switch the microswitch 38 by rocking the lever 38A of the microswitch 38. The switching data of the microswitch 38 is received by a control unit 8 and used as control data for the whole printer. When the microswitch 38 is switched (e.g. turned on), the printer is judged operational.

In the laser beam printer 10 thus constructed, its operation before its condition is operational is prevented as follows:

As shown in FIG. 4, while the clamshell 30 is incompletely closed and not locked, the sensor pin 35 is caused to project downwardly from the undersurface 33A of the press locking member 33 and is prevented from being actuated and, therefore, the microswitch 38 unactuated.

As shown in FIG. 5, the undersurface 33A of the press locking member 33 is caused to press the clamp portion 5A of the developing unit 5 to affix the developing unit 5 to the body 20 when the clamshell 30 is completely closed after the developing unit is fitted in position. The sensor pin 35 is then pressed by the clamp portion 5A to have the microswitch 38 turned on, whereby the printer can be operated.

As shown in FIG. 6, the microswitch 38 remains unactuated when the developing unit 5 is not fitted in position, though the clamshell 30 is completely closed. The printer, accordingly, cannot be operated when the developing unit is missing.

As set forth above, the developing unit is locked to the body by closing the upper component member and, by abutting the closed state detection means of the upper component member against the developing unit, the locking mechanism of the developing unit can be dispensed with. Thus, the detection means of the developing unit is simultaneously usable as the means for detecting the closed state of the upper component member. The printer can thus be made simple in construction and less costly.

What is claimed is:

1. An image recording apparatus employing an electrophotographic process wherein a recording medium is fed along a predetermined feed path, a photoconductive drum, on which a toner image is formed, is arranged below said feed path, and a transfer unit is arranged above said feed path oppositely to said photoconductive drum so as to transfer the toner image formed on said photoconductive drum onto the undersurface of the recording medium; wherein an upper component arranged above said photoconductive drum is arranged openably with respect to a lower component in which said photoconductive drum and a unit which is exchangeable are disposed; and wherein a detecting member which detects the presence of said exchangeable unit, when said upper component is closed with respect to said lower component, is provided to said upper component.

2. The apparatus according to claim 1, wherein said lower component is a body and said upper component is a clamshell pivoted at one end to said body while the other end of said clamshell is movable toward and away from said body.

3. The apparatus according to claim 1, wherein said detecting member comprises a bar-shaped mechanical switch spring-biased to its inoperative position, one end of which is protruded out of said upper component, and wherein said switch is pushed toward its operative position against biasing force by said exchangeable unit when said upper component is closed with respect to said lower component.

4. The apparatus according to claim 3, wherein said exchangeable unit is arranged to be stably seated in said lower component by a lock member which is swingable between its operative position where said exchangeable unit is press-locked and its inoperative position where said exchangeable unit is loosened to be detachable; and wherein said lock member is prevented from swinging when said upper component is closed to said lower component.

5. An image recording apparatus employing an electrophotographic process wherein a recording medium is fed along a predetermined feed path, a photoconductive drum on which a toner image is formed is arranged below said feed path, and a transfer unit is arranged above said feed path opposetly to said photoconductive drum so as to transfer the toner image formed on said photoconductive drum onto the undersurface of the recording medium; wherein an upper component arranged above said photoconductive drum is arranged openly with respect to a lower component in which said photoconductive drum and an exchangeable developing unit are disposed; wherein said exchangeable developing unit is press-locked by said upper component so as to be stably seated into said lower component when said upper component is closed with respect to said lower component, and wherein a detecting member which detects the presence of said exchangeable unit when said upper component is closed with respect to said lower component, is provided to said upper component.

6. The apparatus according to claim 5, wherein said lower component is a body and said upper component is a clamshell pivoted at one end to said body while the other end of said clamshell is movable toward and away from said body.

7. The apparatus according to claim 5, wherein said detecting member comprises a bar-shaped mechanical switch spring-biased to its inoperative position, one end of which protruder outwardly from said upper component, and wherein said switch is pushed toward its operative position against biasing force by said developing unit when said upper component is closed with respect to said lower component.

8. The apparatus according to claim 7, wherein said developing unit is arranged to be stably seated in said lower component by a lock member which is swingable between its operative position where said exchangeable unit is press-locked and between its inoperative position where said exchangeable unit is loosened to be detachable; and wherein said lock member is prevented from swinging when said upper component is closed to said lower component.

* * * * *

UNITED STATES PATENT AND TRADEMARK OFFICE

CERTIFICATE OF CORRECTION

PATENT NO. : 4,952,974

DATED : August 28, 1990

INVENTOR(S) : Seiichi MORI

It is certified that error appears in the above-identified patent and that said Letters Patent is hereby corrected as shown below:

Title Page:

In the Abstract, line 6, of the printed patent, change "oppositley" to ---oppositely---.

Column 1, line 19, delete "is" before "a".

Column 1, line 39, change "transfer" to ---transferring---.

Column 1, line 64, change "the" to ---that---.

Column 2, line 11, delete "therefor".

Column 2, line 38, change "ACCOMPANY" to ---ACCOMPANYING---.

Column 3, line 18, insert ---a--- after "by".

Column 3, line 23, insert ---,--- after "52".

Column 3, line 34, insert ---,--- after "51".

Column 3, line 35, insert ---30--- after "clamshell".

Column 3, line 36, change "to" to ---in---.

Column 3, line 37, change "in" to ---to---.

Column 3, line 37, insert ---51--- after "lever".

Column 3, line 40, change "mating pins 32" to ---lever 51---.

Column 3, line 66, delete "following" (second occurrence).

Column 3, line 67, insert ---following--- before "order".

Column 4, line 17, change "7" to ---6---.

Column 4, line 34, change "the upward" to ---above---.

Column 6, line 21 (line 6 of claim 5), change "opposetly" to ---oppositely---.

Column 6, line 26 (line 11 of claim 5), change "openly" to ---openably---.

Column 6, line 35 (line 20 of claim 5), change "to" to ---on---.

UNITED STATES PATENT AND TRADEMARK OFFICE
CERTIFICATE OF CORRECTION

PATENT NO. : 4,952,974

DATED : August 28, 1990

INVENTOR(S) : Seiichi MORI

It is certified that error appears in the above-identified patent and that said Letters Patent is hereby corrected as shown below:

Column 6, line 45 (line 4, of claim 7), change "protruder" to ---protrudes---.

Signed and Sealed this
Sixth Day of July, 1993

*Attest:*

*Attesting Officer*

Michael K. Kirk

MICHAEL K. KIRK

*Acting Commissioner of Patents and Trademarks*